US007156753B2

(12) United States Patent
Casner, Jr. et al.

(10) Patent No.: US 7,156,753 B2
(45) Date of Patent: Jan. 2, 2007

(54) GOLF PUTTER HEAD

(75) Inventors: Kenneth Casner, Jr., 37 Mason St., Calumet City, IL (US) 60409; Joseph Casner, 1124 Harding Ave., Calumet City, IL (US) 60409

(73) Assignees: Kenneth Casner, Sr., Calumet City, IL (US); Kenneth Casner, Jr., Calumet City, IL (US); Joseph Casner, Calumet City, IL (US)

( * ) Notice: Subject to any disclaimer, the term of this patent is extended or adjusted under 35 U.S.C. 154(b) by 0 days.

(21) Appl. No.: 10/189,117

(22) Filed: Jul. 2, 2002

(65) Prior Publication Data

US 2004/0005935 A1 Jan. 8, 2004

(51) Int. Cl.
*A63B 53/04* (2006.01)

(52) U.S. Cl. ..... 473/340; 473/344

(58) Field of Classification Search ..... 473/328, 473/344, 340, 314

See application file for complete search history.

(56) References Cited

U.S. PATENT DOCUMENTS

| | | | | |
|---|---|---|---|---|
| 2,491,383 | A | 12/1949 | Liolich | |
| 3,064,975 | A | 11/1962 | Smith | |
| 3,085,804 | A | 4/1963 | Pieper | |
| 3,851,877 | A | 12/1974 | Giambazi | |
| D234,208 | S | 1/1975 | Cook | |
| D247,585 | S | 3/1978 | Duclos | |
| 4,162,074 | A * | 7/1979 | Thomson | 473/330 |
| 4,265,451 | A * | 5/1981 | Bernhardt | 473/313 |
| D279,497 | S | 7/1985 | Brown | |
| 4,679,792 | A * | 7/1987 | Straza et al. | 473/329 |
| D291,343 | S | 8/1987 | Shearer | |
| 4,921,253 | A | 5/1990 | Tesori | |
| 5,133,555 | A * | 7/1992 | Bailey | 473/201 |
| 5,193,806 | A | 3/1993 | Burkly | |
| D346,002 | S | 4/1994 | Collins | |
| 5,308,068 | A * | 5/1994 | Strand | 473/251 |
| 5,333,870 | A | 8/1994 | Stevenson, Jr. | |
| 5,411,263 | A | 5/1995 | Schmidt et al. | |
| D363,327 | S | 10/1995 | Greene et al. | |
| D363,328 | S | 10/1995 | Greene et al. | |
| D363,330 | S | 10/1995 | Greene et al. | |
| 5,494,288 | A | 2/1996 | Jimenez et al. | |
| D368,505 | S | 4/1996 | Greene et al. | |
| 5,601,499 | A | 2/1997 | Segaline | |
| 5,624,329 | A | 4/1997 | Schneebeli | |
| 5,683,307 | A | 11/1997 | Rife | |
| 5,707,299 | A * | 1/1998 | McKenna | 473/241 |
| 5,827,130 | A | 10/1998 | Jimenez et al. | |
| 6,217,459 | B1 | 4/2001 | Purcell | |
| 6,273,832 | B1 | 8/2001 | Helmstetter et al. | |
| 6,447,405 | B1 * | 9/2002 | Chen | 473/328 |

* cited by examiner

*Primary Examiner*—Glenn Caldarola
*Assistant Examiner*—Tom P. Duong
(74) *Attorney, Agent, or Firm*—Marshall, Gerstein & Borun LLP

(57) ABSTRACT

A golf putter head is disclosed wherein the putter head has a sole that defines an arcuate surface in two directions—from the toe to the heel and from the tail or rear end of the putter head to the putter face. As a result, the position of the putter head, hosel and shaft may be moved by the golfer without adversely affecting the performance of the putter. Further, the arcuate surface of the sole from the tail to the putter face reduces drag or friction in the event the putter head strikes the ground before striking the ball. The arcuate surface of the sole also provides for improved face balance of the putter head.

9 Claims, 5 Drawing Sheets

GOLF PUTTER HEAD

TECHNICAL FIELD

A golf putter head is disclosed. More specifically, a golf putter head is disclosed with a sole that defines an arcuate surface as the sole extends from the toe to the heel of the putter head and, further, that defines an arcuate surface as the sole extends from the tail or rear side of the putter head to the face of the putter head.

BACKGROUND OF THE RELATED ART

Golf putters come in a variety of sizes and styles. Further, there are numerous approaches to putting which will affect the size and type of putter used by a player. Specifically, there is no one particular stance, posture or grip that is preferred by most players. Instead, successful golfers, including professional golfers, employ different techniques to achieve success. Further, serious golfers will often make changes in their putting technique during the course of a single season or over the course of several years.

For example, many golf instructors advise theirs students to adjust their stance so that their eyes are disposed vertically above the ball which, according to this theory, enables the golfer to move the putter head through the correct line towards the intended target. However, this technique requires the golfer to stand closer to the ball than is naturally comfortable. As a result, a golfer may have already purchased a putter with a shaft angle that is inappropriate or, in other words, results in the handle of the shaft engaging the golfer's waist or thighs after the golfer has moved closer to the ball.

Further, because most putters include a relatively flat sole, the shaft angle cannot be adjusted because the sole of the putter head must lie flat on the ground and raising or lowering the shaft to accommodate a different stance would result in poor contact between the putter face and the ball or a "mishit."

In addition to the position of the head or eyes relative to the ball, golfers may make other changes that would affect the size of the putter and the shaft angle. For example, the width of the stance, or the distance between the golfer's feet will often undergo changes during a golfer's career. Golfers may also "open" or "close" their stance to correct alignment problems. For example, some golfers prefer an open stance where the forward foot is moved farther away from the ball than the rearward foot which gives the golfer a more clear view of the target. However, some golfers tend to pull their puts using an open stance and may switch to a closed stance where the rearward foot is moved back away from the ball.

Many golfers will also change the position of their hands. For example, some golfers prefer that their arms be fully extended to create a pendulum motion as the putter is swung back and forward through the ball. Other golfers are more comfortable with the arms being bent and the hands closer to their body.

The above changes and other adjustments that can be made to anyone's putting technique will obviously affect the optimal size and type of putter employed. As a result, many golfers purchase numerous putters over the course of their golfing careers. Some golfers may purchase more than one putter over the course of a single season.

One type of putter that has been developed which enables a golfer to make some changes to his or her putting stance without requiring a new putter are putters that include a sole with a curved or arcuate surface from the toe to the heel of the putter head as opposed to a flat surface. Putters with such curved or arcuate soles enable the golfer to adjust the position of the grip or shaft to achieve a comfortable position without severely or adversely affecting the position of the putter head relative to the ball.

However, putters with curved or arcuate soles suffer from a common drawback associated with putters having flat soles. Specifically, the amount of surface area contact between the putter sole and the ground or the drag experienced if the putter sole engages the ground during a putting stroke is substantial. If the golfer makes an error in the stroke resulting in the putter sole engaging the ground before the putter head strikes the ball, the speed of the putter head is slowed substantially thereby resulting in a short shot. Even though the sole is curved from heel-to-toe, the curvature is relatively slight and the sole is flat in the face to rear direction which still provides for a substantial amount of surface contact between the sole and the ground in the event of a poor stroke. Further, the junction between the putter face and the sole is typically a right angle which results in a leading edge that, if engaged with the ground, results in a substantial drag between the putter head and the ground which reduces the putter head speed and results in a short shot and/or a shot that is off line.

The balance of the putter head from heel-to-toe is an essential design component. If the putter head is weighted so that the toe has a greater mass than the heel, it is difficult for the golfer to maintain the putter head in correct alignment through the shot. That is, the greater mass of the toe causes the toe to proceed through the stroke with a greater momentum, causing the putter face to close, or the toe to move at a slightly faster rate than the heel thereby causing the shot to be pulled to the left for a right-handed golfer or pulled to the right for a left-handed golfer. In contrast, if the heel of the putter head has a greater mass than the toe, the opposite can happen resulting in the shot being pushed to the right for a right-handed golfer or pushed to the left for a left-handed golfer.

Therefore, there is a need for an improved golf putter head that solves the three problems mentioned above. Specifically, there is a need for an improved golf putter head which enables adjustments to the golfer's stance without requiring a new or different putter. Further, there is a need for an improved golf putter head that is more forgiving in terms of mishits where the golfer mistakenly engages the sole of the putter with the ground prior to striking the ball. Still further, there is a need for an improved golf putter head that solves the two aforenoted problems in addition to providing correct heel-to-toe balance of the putter head.

SUMMARY OF THE DISCLOSURE

In satisfaction of the aforenoted needs, an improved golf putter head is disclosed which comprises a head body with a sole that defines an arcuate surface as the sole extends between the toe and the heel wherein any line extending between the toe and the heel along the sole parallel to the putter face is defined by a single radius. Further, the sole also defines an arcuate surface as the sole extends from the tail towards the face wherein any line extending along the sole from the tail towards the face and perpendicular to the face is defined by a single radius. Thus, the sole of the putter head is arcuate in two ways—from the toe to the heel and from the tail to the face. As a result, the angle of the putter shaft relative to the ground or the player is not critical and minor adjustments may be made to the putter stance without changing putters. Further, the arcuate surface from the tale to the putter face provides for a very forgiving putter head with minimal ground contact or drag in the event the golfer makes a mishit causing the putter head to engage the ground as the putter head moves towards the ball.

In a refinement, the arc defined by the sole as the sole extends from the tail or rear end of the putter head to the face also includes a "bottom" that is laterally offset from the junction between the sole and the face. That is, the bottom of the arc is disposed rearward of the face and therefore the junction of the sole and the putter face is disposed vertically above this arcuate bottom. As a result, if the golfer makes a mishit resulting in the sole of the putter head engaging the ground before the putter face engages the ball, this bottom of the arc engages the ground and not the junction between the sole and the face.

The resulting putter head provides for maximum adjustability of the golfer's putting position, reduced drag in the event the putter head mistakenly engages the ground before striking the ball an improved toe-to-heel face balance.

BRIEF DESCRIPTION OF THE DRAWINGS

The invention is illustrated more of less diagrammatically in the accompanying drawings wherein.

Figure 1:
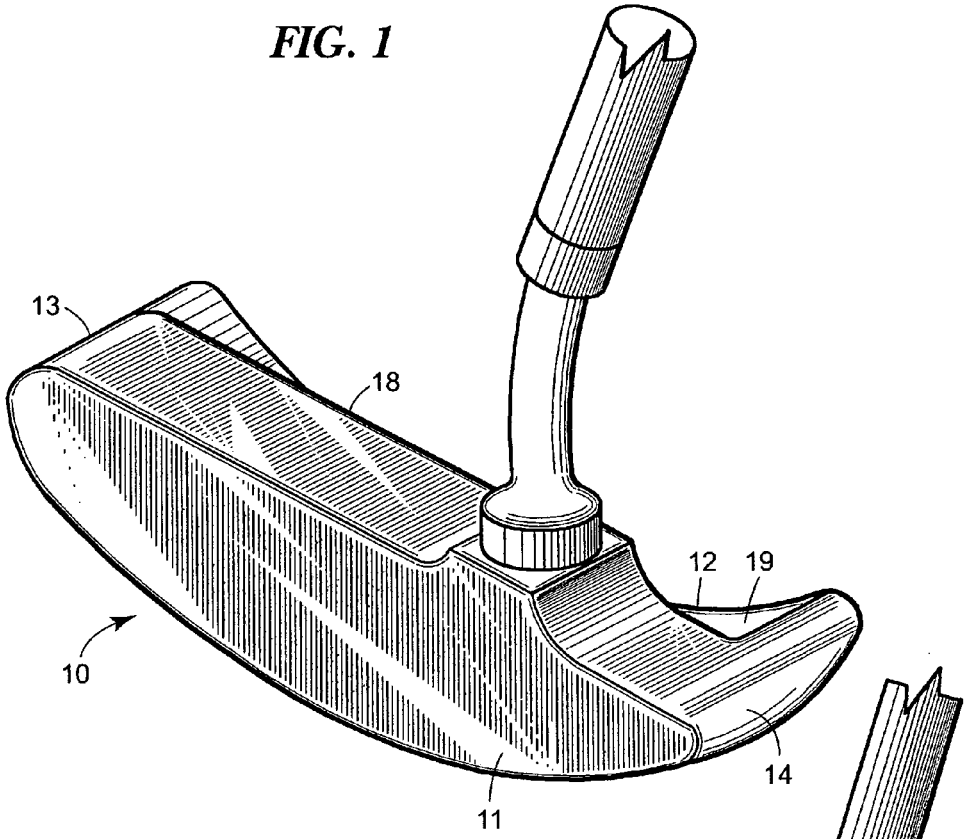
FIG. 1 is a perspective view of one disclosed putter head connected to a hollow and a partial view of a shaft.

The drawings are not necessarily to scale. In certain instances, details which are not necessary for an understanding of the disclosed putter heads or which render other details difficult to perceive may have been omitted. It should be understood, of course, that this disclosure is not necessarily limited to the particular embodiments illustrated herein.

DETAILED DESCRIPTION OF THE PRESENTLY PREFERRED EMBODIMENTS

A first disclosed putter head 10 is disclosed in FIGS. 1–4. The putter head 10 includes a face 11 and a tail 12. The putter head also includes a toe 13 and a heel 14.

Figure 2:
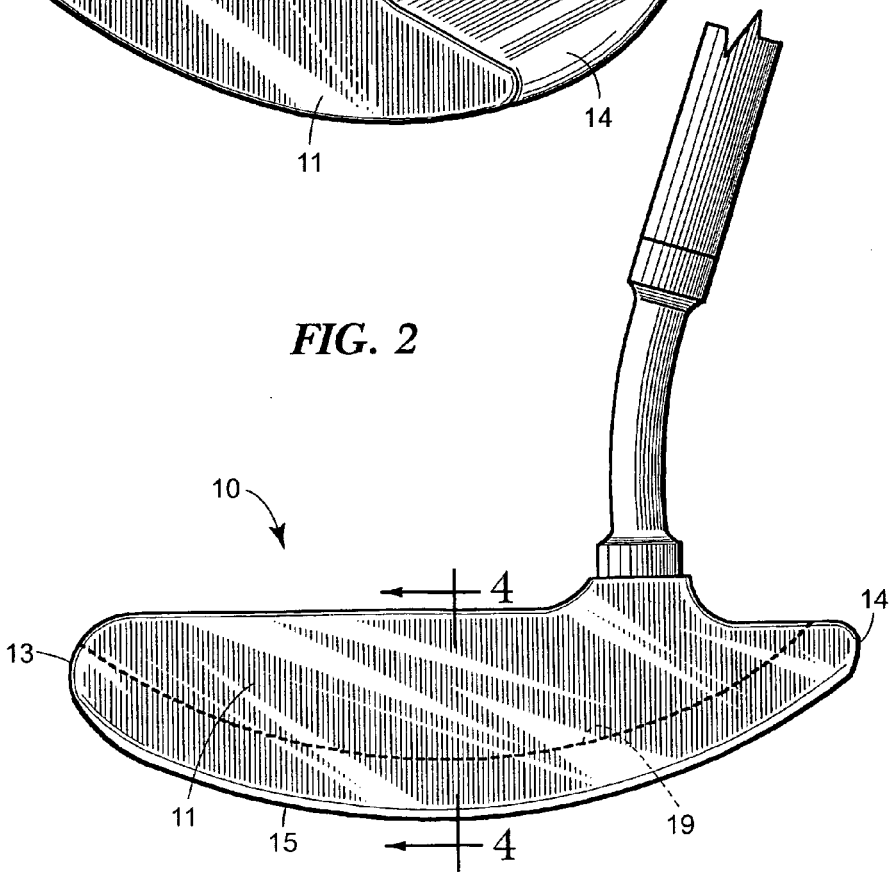
FIG. 2 is a front plan view of the putter head shown in FIG. 1.
Figure 4:
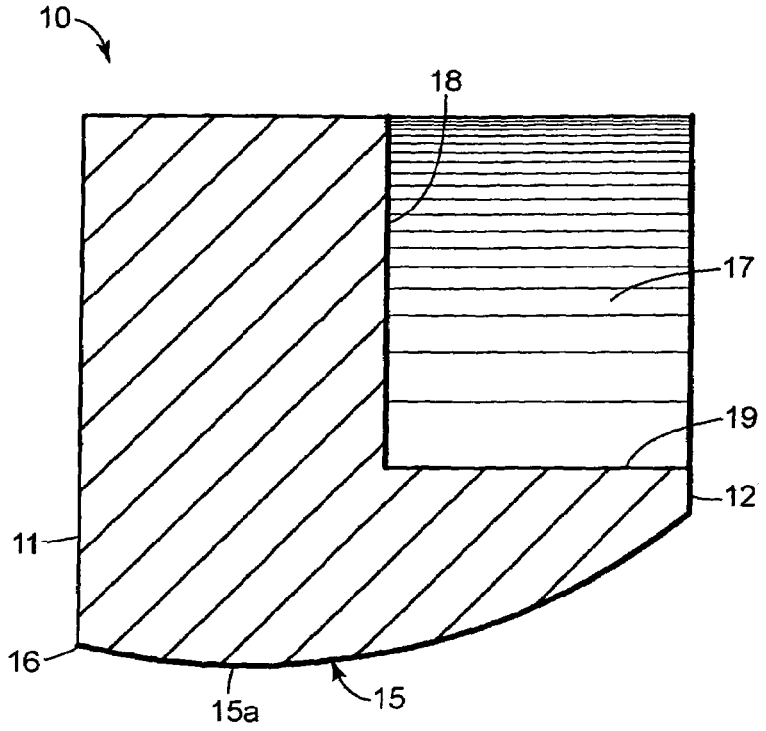
FIG. 4 is a sectional view taken along line 4—4 of FIG. 2.

A sole 15 extends between the toe 13 and heel 14 as well as the face 11 and tail 12. As best seen in FIGS. 2 and 4, the sole 15 defines an arcuate surface as it extends from the toe 13 and heel 14, or substantially between the toe 13 and heel 14, and as the sole 15 extends between the tail 12 and the face 11. Thus, the sole 15 is arched in two ways, from the toe 13 to the heel 14 and from the tail 12 to the face 11. It will also be noted, from FIG. 4, that the arc defined by the sole 15 as it extends from the tail 12 to the face 11 includes an arcuate bottom which is shown approximately at 15*a*. This arcuate bottom 15*a* is disposed in a laterally offset position from the face 11. As a result, the junction 16 between the sole 15 and face 11 is disposed vertically above the arcuate bottom 15*a*. The position of the junction 16 above the arcuate bottom 15*a* prevents this junction 16 from engaging the ground in the case of a poor stroke which results in the putter head 10 engaging the ground before striking the ball. If the putter head 10 engages the ground before striking the ball, it will most likely do so at or around the arcuate bottom 15*a* which provides little resistance or drag and, even if such a poor stroke is made, the adverse affects to the resulting shot are minimized. The putter head 10 also includes a recess 17 which is defined by a rear wall 18 and rear flange 19 which results in a reduction of the overall weight of the putter head 10.

Figure 7:
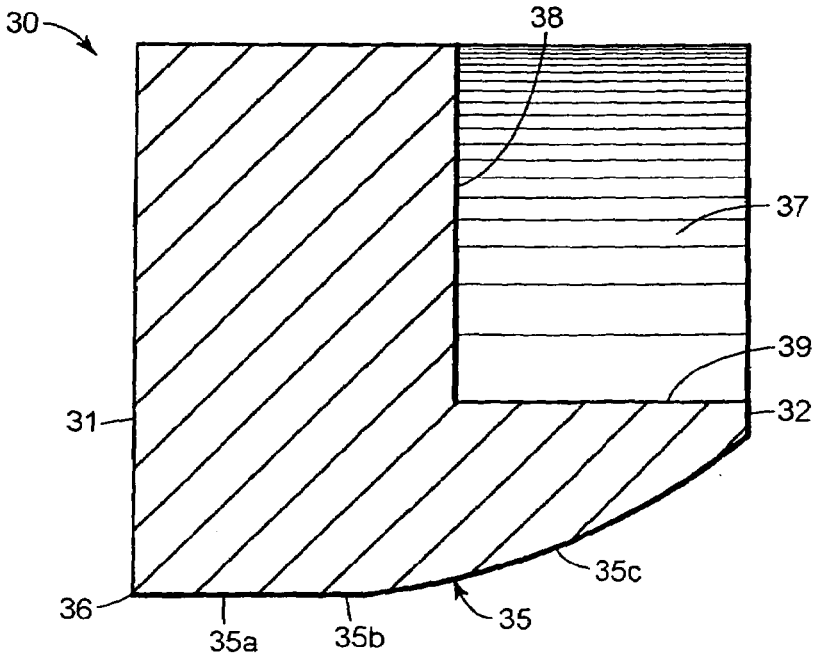
FIG. 7 is a sectional view taken along line 7—7 of the FIG. 6.
Figure 5:
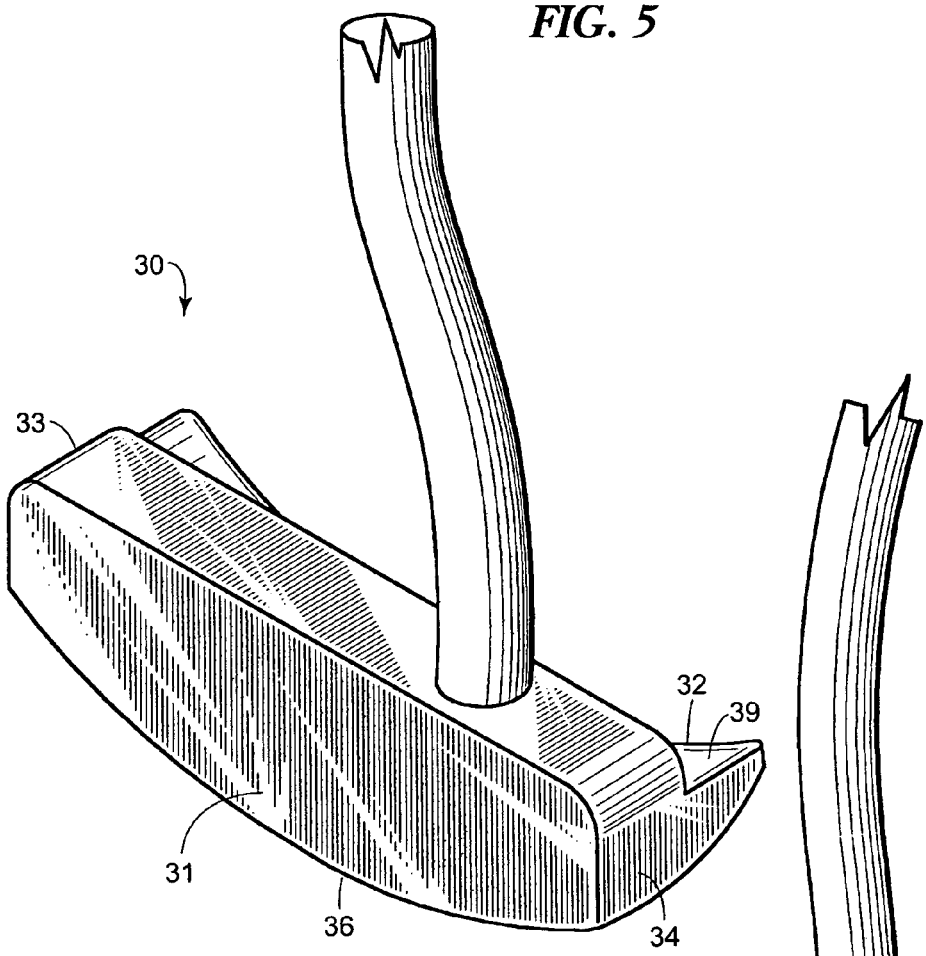
FIG. 5 is a perspective view of a second disclosed putter head and a partial view of a shaft attached thereto.
Figure 6:
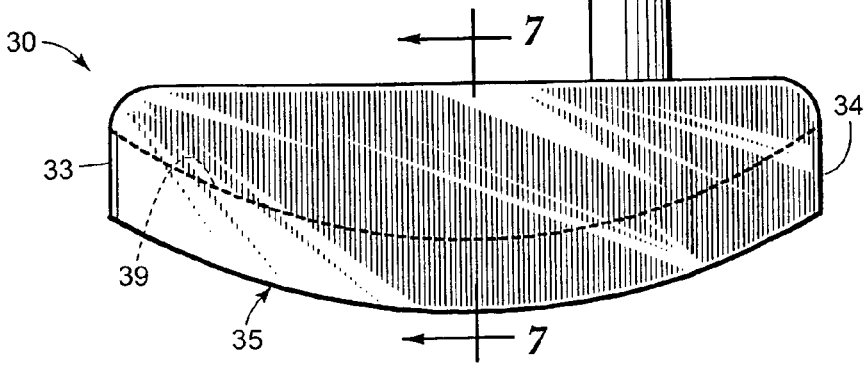
FIG. 6 is a front plan view of the putter head shown in FIG. 5.

Turning to FIGS. 5–7, a second putter head 30 is disclosed which similarly includes a face 31, a tail 32, a toe 33 and a heel 34. The sole 35 extends between the toe 33 and heel 34 (see FIG. 6) as well as between the tail 32 and face 31 (see FIG. 7). In FIG. 7, the sole 35 includes a first arcuate surface 35*a* and second arcuate surface 35*c* separated by the mid-point 35*b*. In the putter head 30, the first arcuate surface 35*a* defined by the sole 35 is the flattened area disposed laterally rearward of the junction 36 between the putter face 31 and sole 35. This flattened area 35*a* between the junction 36 and the mid-point 35*b* does not provide as low a drag coefficient provided by the sole 15 of the putter head 10 and is therefore more appropriate for more advanced players. The second arcuate surface 35*c* is arched from the toe 33 to heel 34 and from the mid-point 35*b* to the tail 32. The putter head 30 also includes a recess 37 which is defined by a rear wall 38 and rear flange 39.

Figure 8:
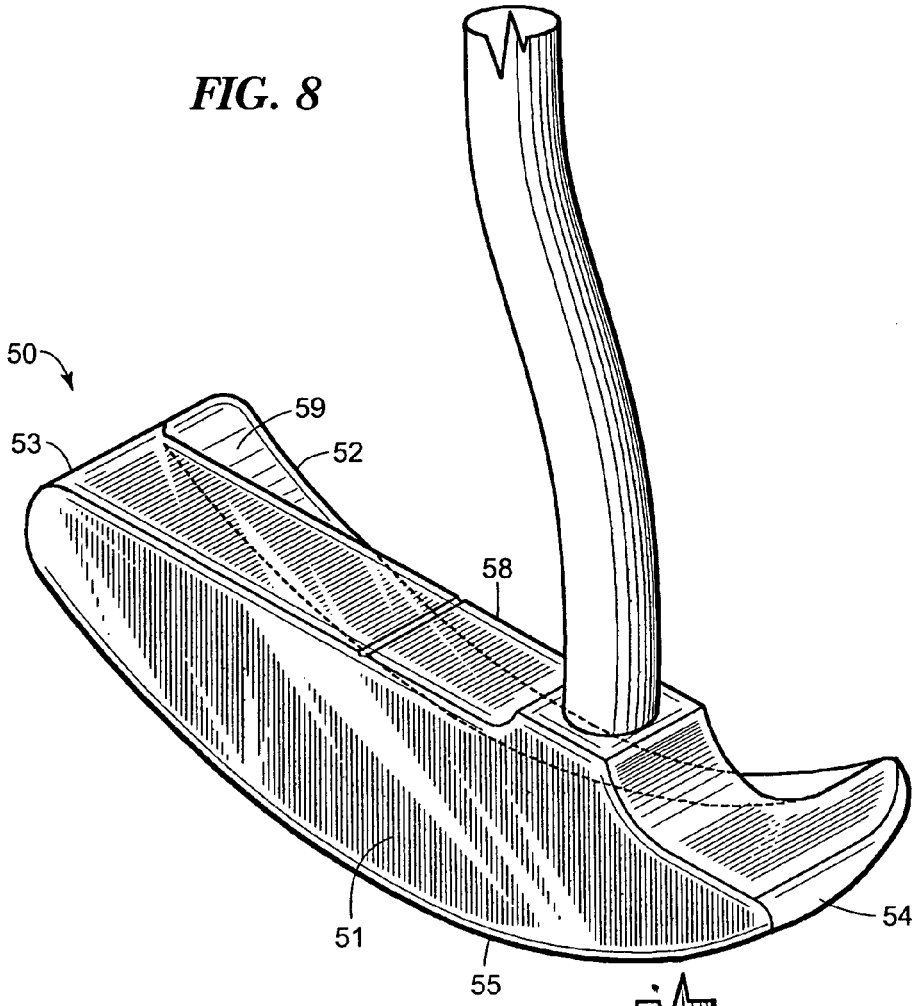
FIG. 8 is perspective view of another disclosed putter head and partial view of a shaft attached thereto.
Figure 9:
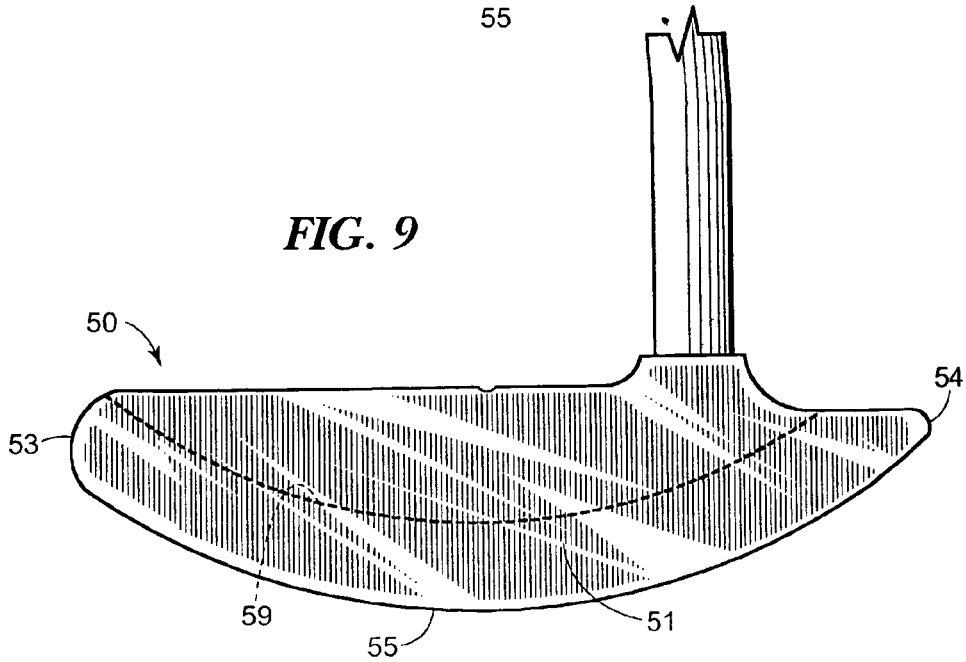
FIG. 9 is a front plan view of the putter head shown in FIG. 8.

Another variation is illustrated in the putter head 50 as shown in FIGS. 8 and 9. The putter head 50 also includes a face 51, a tail 52, a toe 53 and a heel 54. An arcuate sole 55 extends between the toe 53 and heel 54 as well as between the tail 52 and face 51 in a manner similar to the embodiment 10 illustrated in FIGS. 1–4. Again, a rear recess is defined by a rear flange 59 and rear wall 58.

Figure 10:
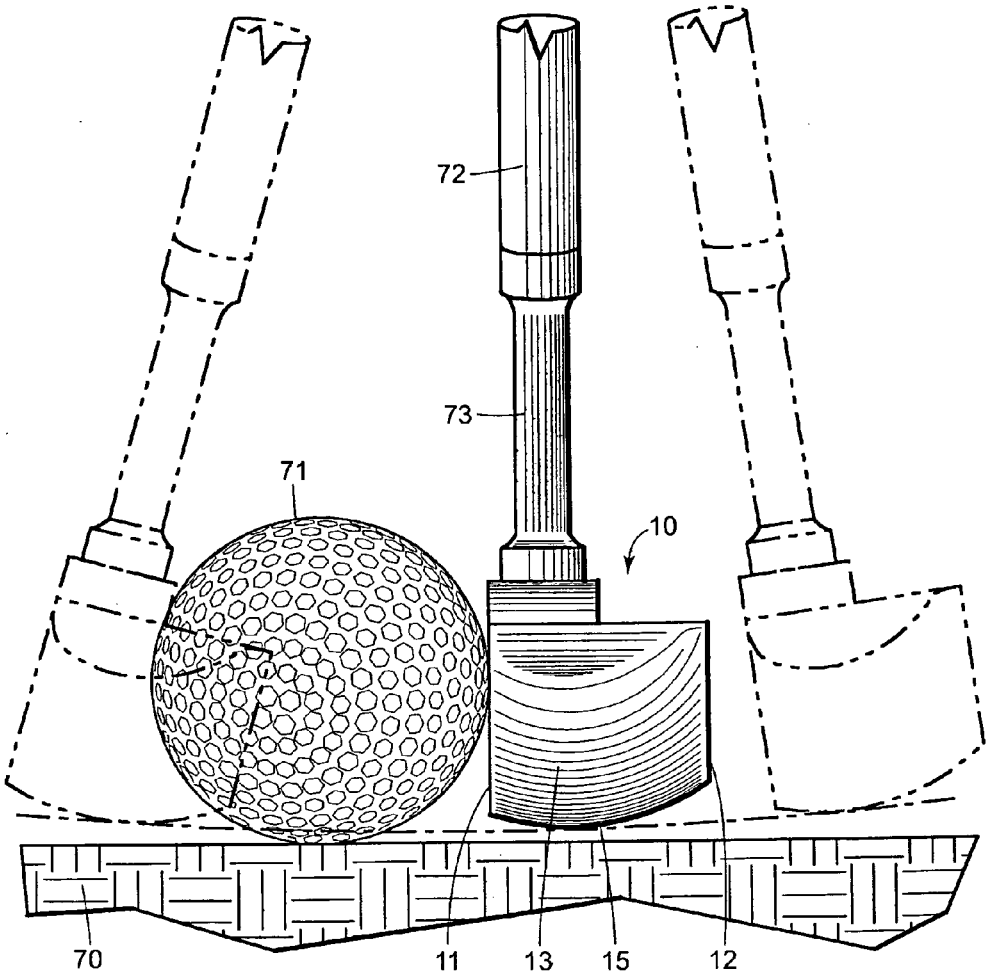
FIG. 10 is an end view of a disclosed putter head engaging a golf ball.
Figure 3:
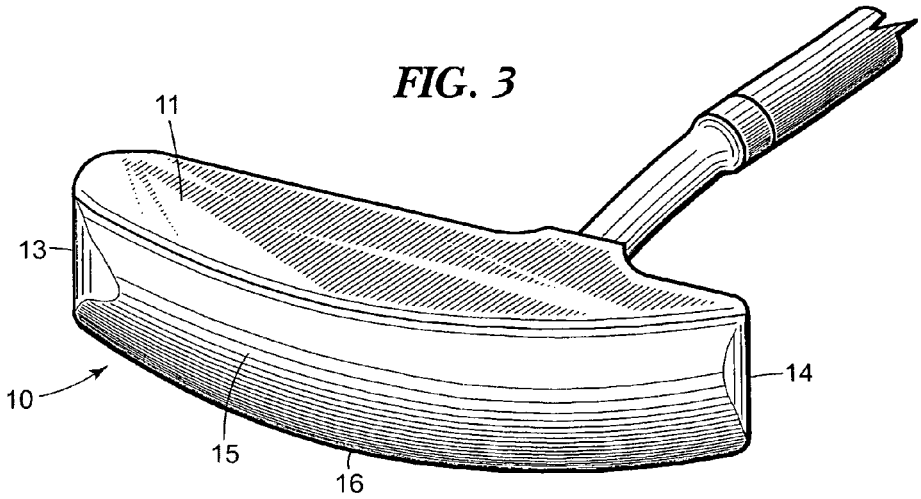
FIG. 3 is a bottom perspective view of the putter head shown in FIGS. 1 and 2.

Turning to FIG. 10, it can be seen that the arcuate surface 15 of the putter head 10 would provide little resistance in the event the putter head 10 strikes the ground 70 prior to striking the ball 71. Thus, the arcuate surface of the sole 15 as it extends from the tail 12 to the face 11 provides a low drag or low coefficient of friction in the event the putter head 10 engages the ground 70 during a poor stroke or "mishit." Further, the arcuate curvature of the sole 15 as it extends from the toe 13 to the heel 14 also enables the golfer to adjust the position or angle of the putter head 10 vis a vis the ground 70 easily without requiring the shaft 72 to be lengthened or shortened or any adjustment of the hosel 73 which connects the shaft 72 to the putter head 10.

As a result, the putter heads 10, 30 and 50 as disclosed herein can be used with a variety of different putting stances and styles and enable a golfer employing one of these putter heads 10, 30 and 50 to adjust his or her stance, style or putting technique without resorting to modification of the resultant putters, hosel 73 or shaft 72. Further, the design of the putter heads 10, 30 and 50 all provide excellent toe-to-heel balancing which makes it easier to keep the putter heads 10, 30 and 50 on line during a putting stroke.

While only certain embodiments have been set forth, alternative embodiments and various modifications will be apparent from the above description to those skilled in the art. These and other alternatives are considered equivalents and within the spirit and scope of this disclosure.

What is claimed is:

1. A golf putter head comprising:

a head body comprising a face and a tail with a sole extending therebetween, the head body further comprising a toe and a heel with the sole extending therebetween, the face adapted to strike a golf ball when the putter head is held in a striking position, the sole including a mid-point disposed along a line parallel to the face and between the face and the tail, the sole defining two arcuate surfaces as the sole extends substantially from the toe to the heel including a first arcuate surface disposed between the face and the mid-point of the sole and a second arcuate surface disposed between the mid-point of the sole and the tail, wherein any line extending substantially along the first or second arcuate surfaces of the sole and parallel to the face is defined by a single radius, wherein any line extending along the second arcuate surface of the sole from the tail towards the mid-point of the sole and perpendicular to the face is defined by a single radius, and wherein any line extending along the first arcuate surface of the sole from the face to the mid-point of the sole and perpendicular to the face is a straight line with no curvature or radius.

2. The golf putter head of claim 1 wherein any line extending along the sole from the tail to the face and perpendicular to the face is defined by a single radius.

3. The golf putter head of claim 2 the arcuate surface defined by the sole as it extends from the tail to the face further comprises an arcuate bottom, the arcuate bottom being disposed along a line parallel to the face and laterally offset from the face so that a junction of the sole and face is disposed vertically above the arcuate bottom.

4. The golf putter head of claim 1 wherein any line extending along the sole from the toe to the heel and parallel to the face is defined by a single radius.

5. The golf putter head of claim 1 the arcuate surface defined by the sole as it extends from the tail to the face further comprises an arcuate bottom, the arcuate bottom being disposed along a line parallel to the face and laterally offset from the face.

6. The golf putter head of claim 5 wherein a junction of the sole and face is disposed vertically above the arcuate bottom.

7. A golf putter comprising:

a shaft connected to a head body, the head body comprising a face and a tail with a sole extending therebetween, the head body further comprising a toe and a heel with the sole extending therebetween, the face adapted to strike a golf ball when the putter head is held in a striking position, the sole including a mid-point disposed along a line parallel to the face and between the face and the tail, the sole defining two arcuate surfaces as the sole extends substantially from the toe to the heel including a first arcuate surface disposed between the face and the mid-point of the sole and a second arcuate surface disposed between the mid-point of the sole and the tail, wherein any line extending along the first or second arcuate surfaces of the sole and parallel to the face is defined by a single radius, wherein any line extending along the second arcuate surfaces of the sole from the tail to the mid-point of the sole and perpendicular to the face is defined by a single radius, and wherein any line extending along the first arcuate surface of the sole from the face to the mid-point of the sole and perpendicular to the face is a straight line with no curvature or radius.

8. The golf putter of claim 7 the arcuate surface defined by the sole as it extends from the tail to the face further comprises an arcuate bottom, the arcuate bottom being disposed along a line parallel to the face and laterally offset from the face.

9. The golf putter of claim 8 wherein a junction of the sole and face is disposed vertically above the arcuate bottom.

* * * * *